US009447566B1

(12) United States Patent
Chen

(10) Patent No.: US 9,447,566 B1
(45) Date of Patent: Sep. 20, 2016

(54) SYSTEMS, DEVICES, AND/OR METHODS FOR MANAGING WATER AND SOAP

(71) Applicant: Zihan Chen, Charlottesville, VA (US)

(72) Inventor: Zihan Chen, Charlottesville, VA (US)

( * ) Notice: Subject to any disclaimer, the term of this patent is extended or adjusted under 35 U.S.C. 154(b) by 0 days.

(21) Appl. No.: 14/720,771

(22) Filed: May 23, 2015

(51) Int. Cl.
*E03C 1/046* (2006.01)

(52) U.S. Cl.
CPC ..... *E03C 1/046* (2013.01)

(58) Field of Classification Search
CPC ..... E03C 1/046
USPC ..... 4/678; 239/422, 428
See application file for complete search history.

(56) References Cited

U.S. PATENT DOCUMENTS

2012/0223159 A1* 9/2012 Gregory ..... E03C 1/046 4/628
2014/0143948 A1* 5/2014 Cochart ..... E03C 1/046 4/676
2015/0315771 A1* 11/2015 Abramson ..... E03C 1/046 4/678

* cited by examiner

*Primary Examiner* — Tuan N Nguyen
(74) *Attorney, Agent, or Firm* — Dale Jensen, PLC; Dale Jensen

(57) ABSTRACT

Certain exemplary embodiments can provide a system comprising a faucet. The faucet can comprise a discharge assembly. The discharge assembly can comprise a middle column. The middle column can comprise a pump activator, which can be constructed to cause the middle column to dispense a liquid soap responsive to user compression.

6 Claims, 6 Drawing Sheets

SYSTEMS, DEVICES, AND/OR METHODS FOR MANAGING WATER AND SOAP

BRIEF DESCRIPTION OF THE DRAWINGS

A wide variety of potential practical and useful embodiments will be more readily understood through the following detailed description of certain exemplary embodiments, with reference to the accompanying exemplary drawings in which.

DETAILED DESCRIPTION

Figure 1:
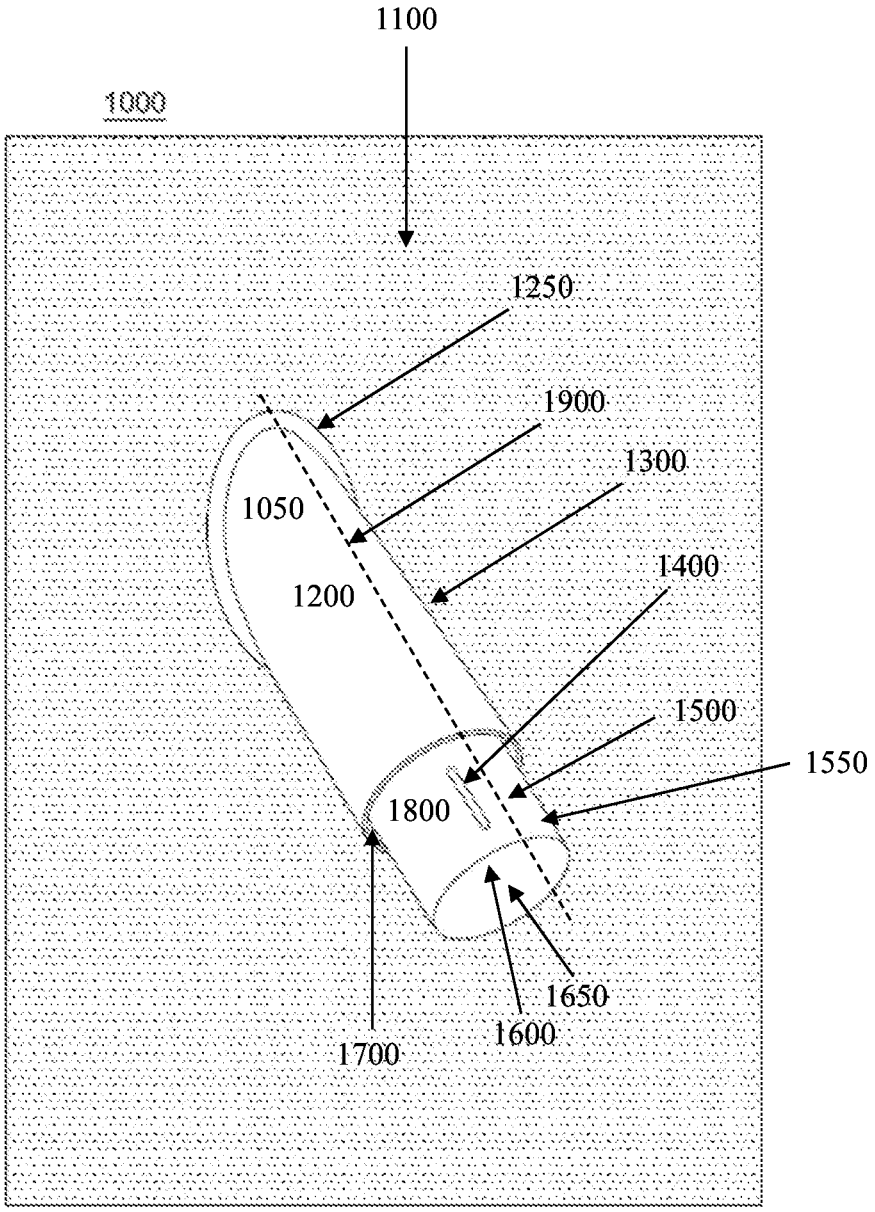
FIG. 1 is a perspective view of an exemplary embodiment of a system 1000.

Certain exemplary embodiments can provide a system comprising a faucet. The faucet can comprise a discharge assembly, which can comprise a middle column. The middle column can comprise a pump activator, which can be constructed to cause the middle column to dispense a liquid soap responsive to user compression.

Certain exemplary embodiments comprise a faucet that is suitable for various kinds of public use and is designed in many ways to achieve great improvements on the user experience; including water and energy savings while having reasonable manufacturing costs. Such advantages come from the design of a simple, yet innovative structure which differs from others.

The user can rotate a knob of the middle column of the faucet for water and push the knob of the middle column of the faucet for hand soap. The challenge of designing a faucet in a completely new layout can be viewed as the challenge of how to break the parts of a traditional faucet and then integrate the parts again, considering their relationship and balance in space to solve common problems of the traditional faucet, with the understanding of economic and environmental considerations.

Problems with traditional faucets can comprise less than optimal hygiene and a relatively poor user experience caused by germ transmission among people touching a faucet knob. In addition, wastes of water can happen because people might leave water running when applying hand soap. Even automatic induction faucets can waste water and energy due to the delay of the induction. In addition, the cost of repair for broken faucets can be relatively high. A redesign of water faucets can improve on such problems by rearranging the spatial connection between the water outlet and the knob and, at the same time, integrating the hand soap dispenser and the knob. The knob is placed in the middle of the outlet which means it is substantially encircled by the water flow coming out of the outlet when the faucet is running. Therefore, substantially all the dirt and hand soap that might be brought by user's hands onto the knob will be washed away relatively quickly (virtually immediately from a user's perspective) via running water after the faucet is turned on by rotating the knob.

Germ transmission is reduced compared to other designs and the knob remains relatively clean for the next user.

In addition from improvements in hygiene, the design of allows user access to the hand soap only when the faucet is turned off since the soap outlet is covered by water when the faucet is on. In this way, water waste caused by the using of hand soap can be significantly reduced.

Certain exemplary embodiments can be used by anyone. Users are benefited with a higher level of hygiene, a better experience of washing hands, and improved energy sustainability. The lifespan of exemplary faucets is expected to be at least as long as the market average lifespan of other faucet products. Benefits from exemplary embodiments include an extremely simple model and inner structure which makes the production and exchange or repair of parts relatively easy. Also, the unique structure and mechanism keeps the appearance relatively clean which is positive for maintaining the faucet in good condition.

Certain exemplary embodiments have a relatively low manufacture cost, great water and energy saving, and a positive user experience. The unique structure of putting the soap dispenser in the middle as the knob is:

- more convenient and/or efficient (a user doesn't need to move a hand significantly and can get the soap relatively quickly);
- it keeps the floor clean (because some time people miss the soap liquid and the soap can drop into the sink instead of the floor, and will be washed away); and/or
- the water flow will cover and surround the middle column which is the hand soap dispenser, so people turn off the water before they can get the soap, this can save a lot of water, because people tend to leave the water on as they are using the hand soap and can waste a significant amount of water.

The unique structure of putting the knob in the middle reduces germ transmission. The water covers the knob when running, so any dirt or soap liquid soap bubbles that left on the knob will be washed away by the water flow. Automatic induction faucets can also reduce germ transmission, but can have a relatively high cost, not be as efficient in amounts of water used (i.e., water keeps running for a time after the hands are moved away from the faucet), can result in relatively high electrical consumption, and can be less reliable.

Certain exemplary embodiments can have a relatively low production cost and can be relatively easy to repair. The incorporation of a faucet and soap dispenser in a single assembly results in simple problem diagnosis and correction.

The hand soap used in exemplary systems can be in the form of liquid or gel. Certain exemplary embodiments dispense water at a default temperature. Temperature adjustments can be made via a master control, which can be constructed to control water temperature for a plurality of faucets. In certain exemplary embodiments, faucets can be half hidden behind a mirror for aesthetic reasons.

FIG. 1 is a perspective view of an exemplary embodiment of a system 1000, which can comprise a faucet 1050, a mounting surface 1100, discharge assembly 1200, a mounting seal 1250, an outer tube 1300, a pop up 1400, a middle column 1500, a pump activator 1550, a dispensing end 1650 of a soap tube 1600 comprised by middle column 1500, an annular region 1700 between outer tube 1300 and middle column 1500, and/or water controller 1800.

Faucet 1050 can comprise discharge assembly 1200. Discharge assembly 1200 can comprise middle column 1500. Middle column 1500 can comprise pump activator

Figure 4:
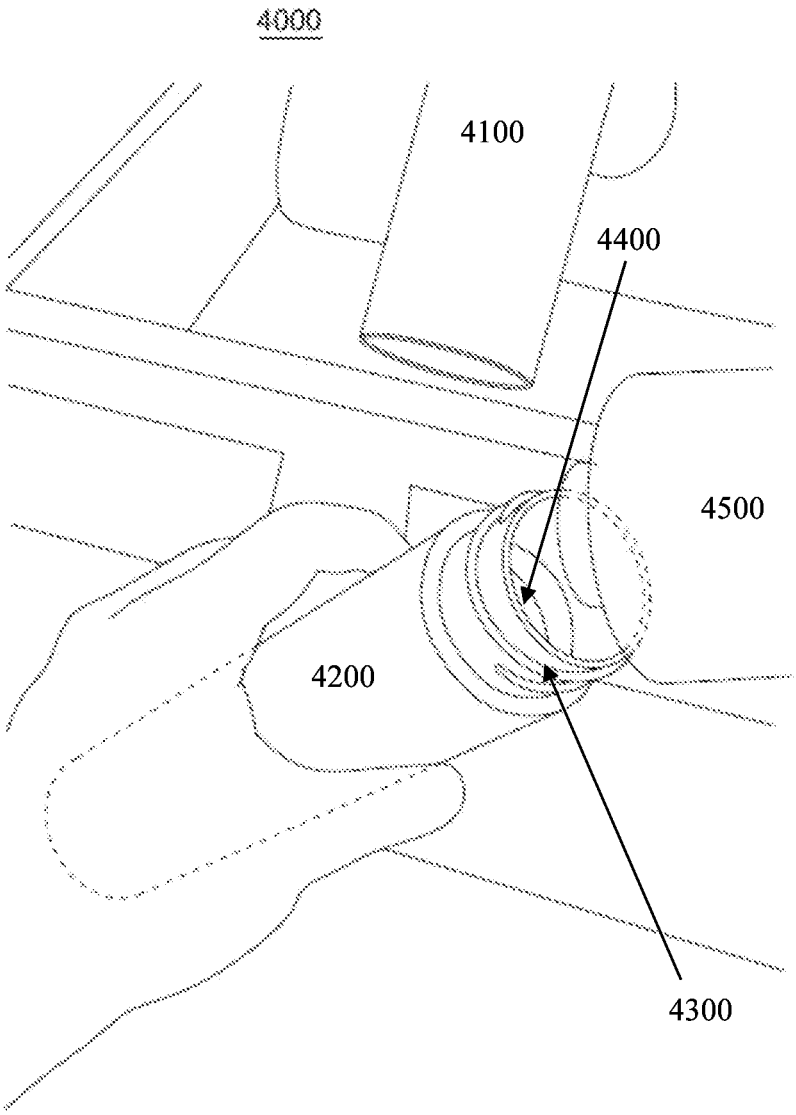
FIG. 4 is a perspective view of an exemplary embodiment of a system 4000.

1550, which can be constructed to cause middle column 1500 to dispense a liquid soap via soap tube 1600 responsive to user compression. Pump activator 1550 substantially surrounds a portion of soap tube 1600; soap tube 1600 comprises dispensing end 1650. Soap tube 1600 can be constructed to receive the liquid soap from a soap reservoir (e.g., soap reservoir 4400 as illustrated in FIG. 4) and convey the liquid soap to a body part of the user through dispensing end 1650 of soap tube 1600.

Outer tube 1300 substantially surrounds a portion of middle column 1500. Outer tube 1300 can be constructed to discharge water from an annular region 1700 between outer tube 1300 and middle column 1500. Middle column 1500 can comprise water controller 1800 constructed to start and stop water flow from annular region 1700 responsive to the user twisting pump activator 1550 by a predetermined amount in a predetermined rotational direction. Pump activator 1550 comprises a substantially fixed pop up 1400 protruding from pump activator 1550. Pop up 1400 can be constructed to increase friction between a hand of the user and pump activator 1550. Pop up 1400 can be offset to the left of a centerline 1900 of pump activator 1550 when viewed facing dispensing end 1650 of soap tube 1600.

Pop up 1400 can be used to increase the friction or be something with that people can use to facilitate turning middle column 1500 to control water flow from system 1000 when they may have slippery hands. Pop up 1400 can be positioned slightly to left of centerline 1900 so that a user viewing pop up 1400 might infer that middle column 1400 should be turned in a clockwise rotational direction to initiate water flow. In addition, since most users will be right handed, positioning pop up 1400 slightly to left of centerline 1900 will allow the user's thumb to be in a relatively comfortable position of 10 or 11 o clock, which is slightly to the left, to match the position of pop up 1400 to facilitate rotating middle column 1500.

Figure 2:
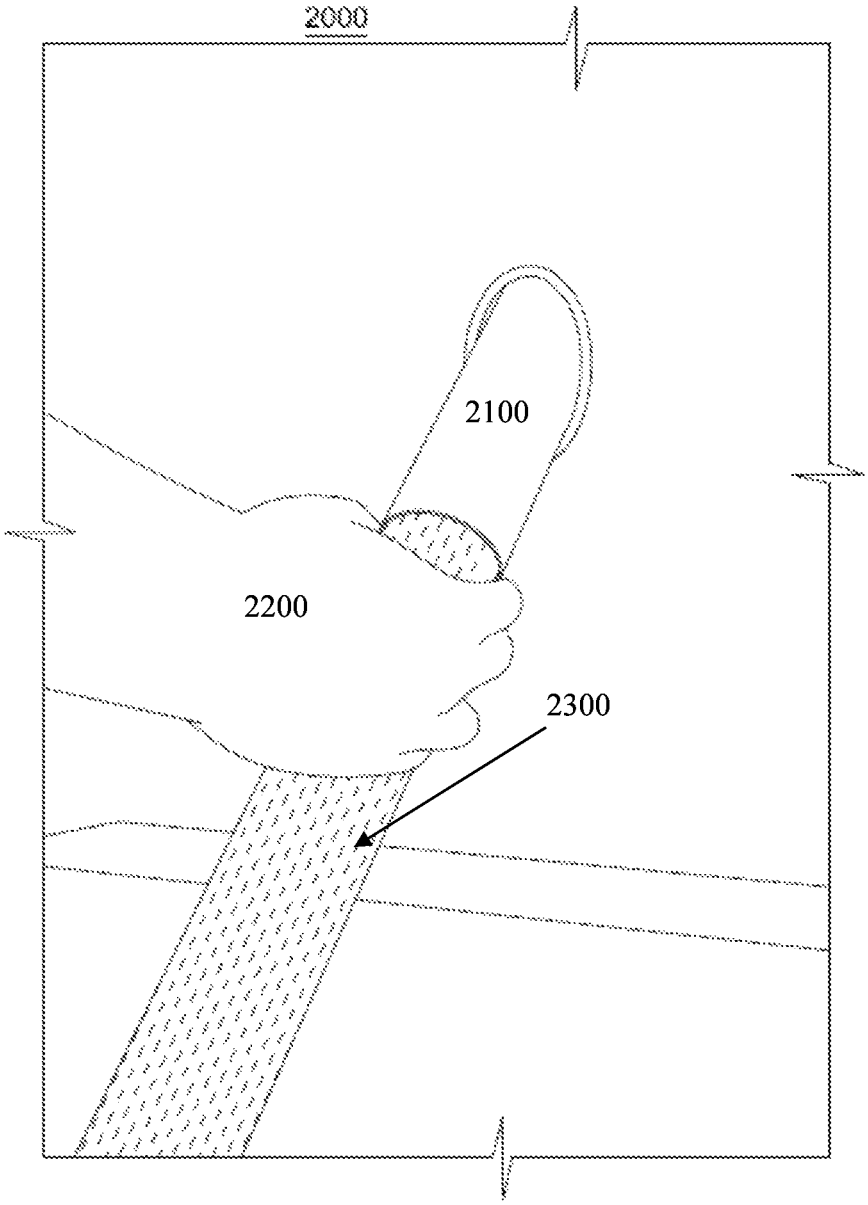
FIG. 2 is a perspective view of an exemplary embodiment of a system 2000.

FIG. 2 is a perspective view of an exemplary embodiment of a system 2000, which comprises a faucet 2100. FIG. 2 illustrates a hand 2200 of a user starting a flow of water 2300 via rotation of a middle column of system 2000 (which is hidden by flow of water 2300).

Figure 3:
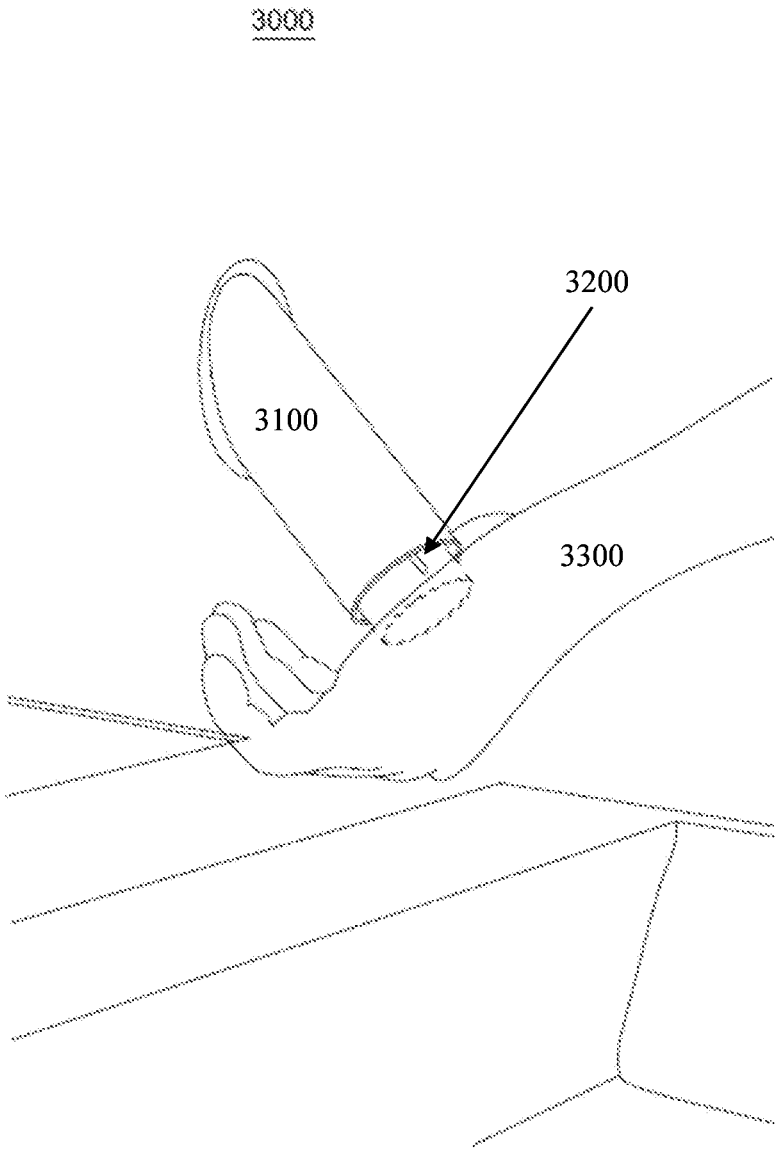
FIG. 3 is a perspective view of an exemplary embodiment of a system 3000.

FIG. 3 is a perspective view of an exemplary embodiment of a system 3000, which comprises a faucet 3100. Faucet 3100 comprises a middle column 3200. FIG. 3 illustrates a hand 3300 of a user starting a flow of soap via compression of middle column 3200.

FIG. 4 is a perspective view of an exemplary embodiment of a system 4000, which comprises a faucet 4100 with middle column 4200 separated therefrom. Middle column 4200 can be coupled to faucet 4100 via threads 4300. FIG. 4 illustrates the user pouring soap from container 4500 to soap reservoir 4400.

Figure 5:
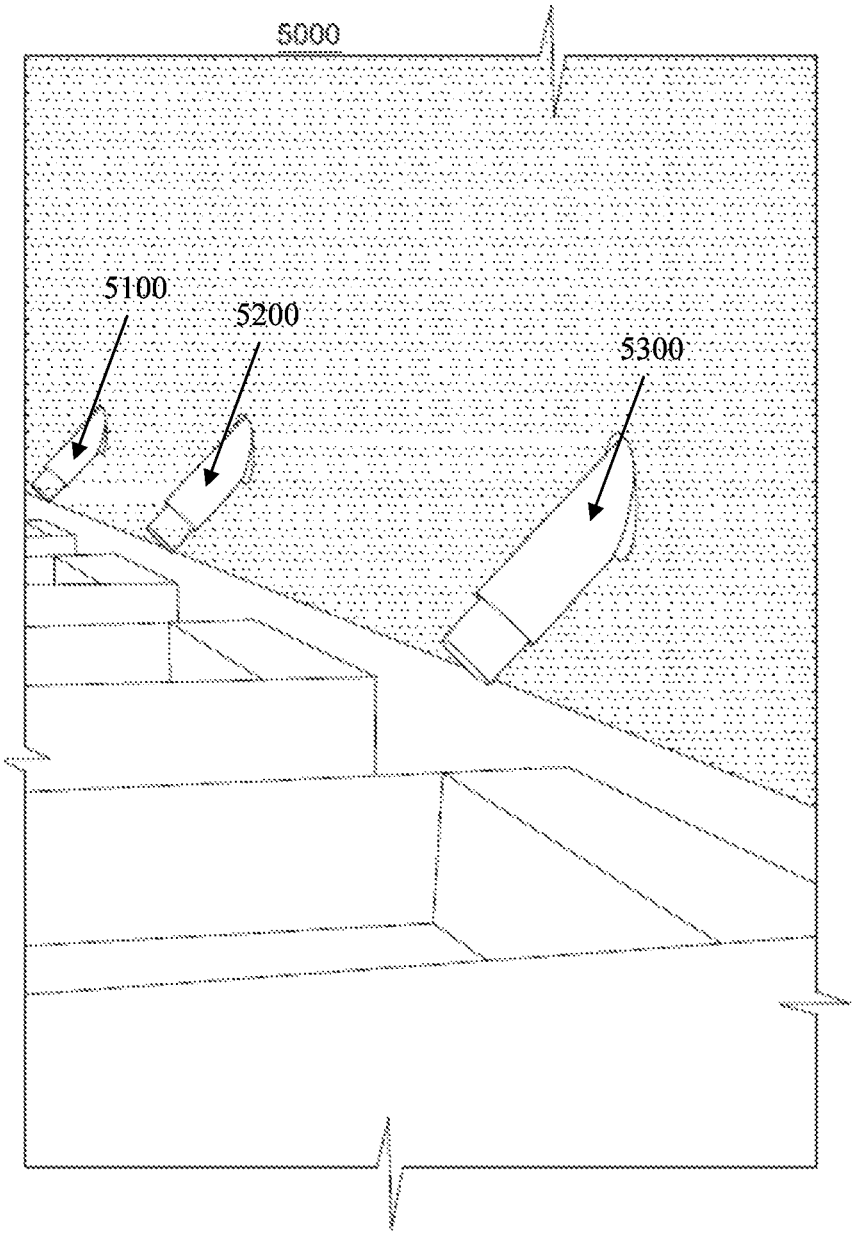
FIG. 5 is a perspective view of an exemplary embodiment of a system 5000.

FIG. 5 is a perspective view of an exemplary embodiment of a system 5000, which comprises a first faucet 5100, a second faucet 5200, and a third faucet 5300. FIG. 5 illustrates a set of faucets for a public facility each with a corresponding sink.

Figure 6:
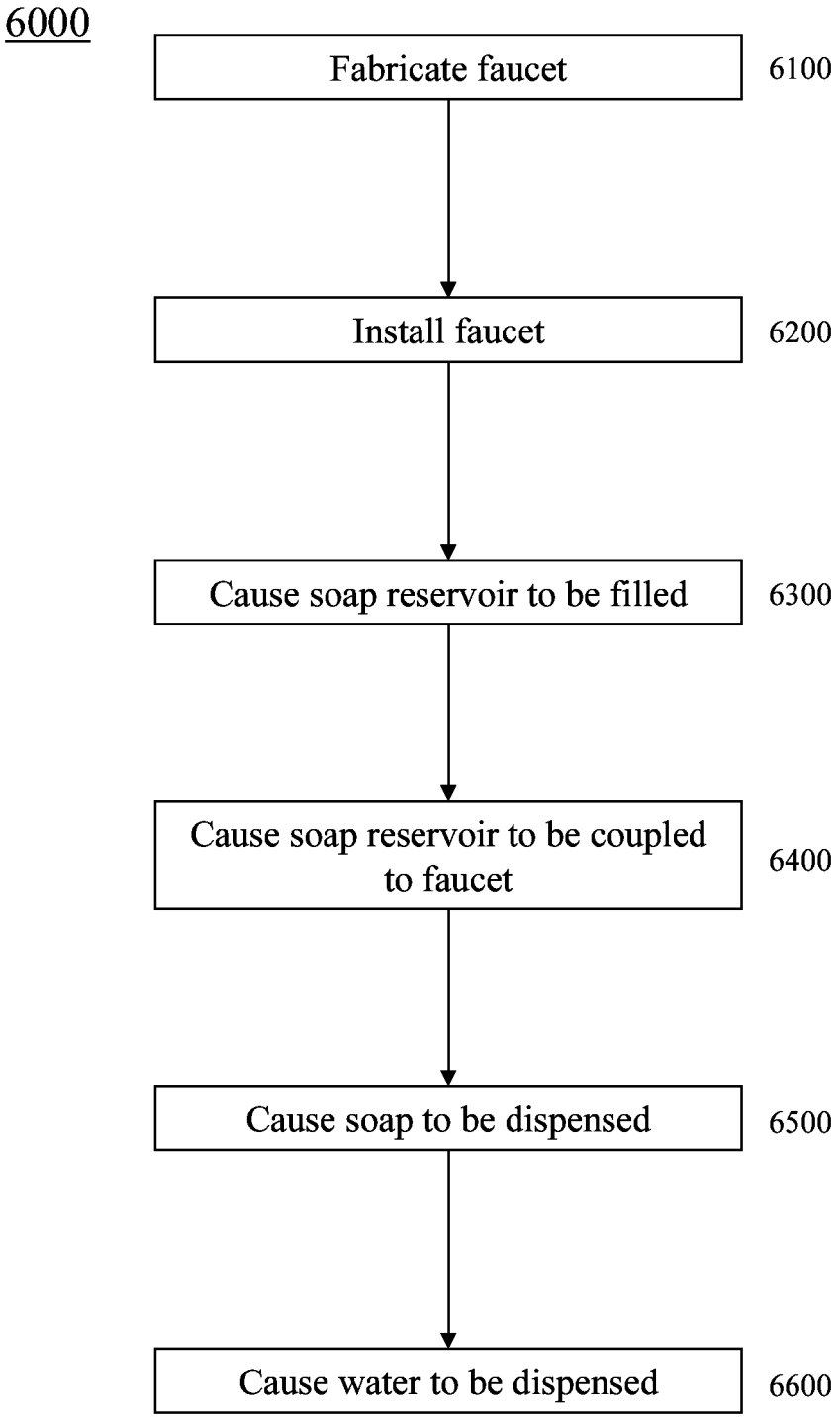
FIG. 6 is a flowchart of an exemplary embodiment of a method 6000.

FIG. 6 is a flowchart of an exemplary embodiment of a method 6000. At activity 6100, a faucet can be fabricated. The faucet can comprise a discharge assembly, which can comprise a middle column. The middle column can comprise:

a pump activator, which can be constructed to cause the middle column to dispense a liquid soap responsive to user compression; the pump activator can comprise:

a pop up protruding from the pump activator; the pop up can be constructed to improve increase friction between a hand of the user and the pump activator; the pop up can be offset to the left of a centerline of the pump activator when viewed facing the dispensing end of the soap tube;

a soap tube, wherein the pump activator can substantially surround a portion of the soap tube; the soap tube can comprise a dispensing end; the soap tube can be constructed to:

receive said liquid soap from a soap reservoir; and convey said liquid soap to a body part of said user through said dispensing end of said soap tube; and/or an outer tube substantially surrounding a portion of the middle column; the outer tube can be constructed to discharge water from an annular region between the outer tube and the middle column; and a water controller; the water controller is constructed to start and stop water flow from the annular region responsive to the user twisting the pump activator by a predetermined amount in a predetermined rotational direction.

At activity 6200, the faucet can be installed. At activity 6300, the soap reservoir can be caused to be filled. At activity 6400, the soap reservoir can be caused to be coupled to the faucet. At activity 6500, soap can be caused to be dispensed from the faucet. At activity 6600, water can be caused to be dispensed from the faucet.

DEFINITIONS

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

a—at least one.

activity—an action, act, step, and/or process or portion thereof.

adapter—a device used to effect operative compatibility between different parts of one or more pieces of an apparatus or system.

amount—a quantity of a distance.

and/or—either in conjunction with or in alternative to.

annular—ring shaped and defining an inner diameter and an outer diameter.

apparatus—an appliance or device for a particular purpose associate—to join, connect together, and/or relate.

body part—a portion of a human.

can—is capable of, in at least some embodiments.

cause—to produce an effect.

centerline—a line that approximately bisects an object.

compression—decreasing an apparent volume of an object by pushing the object.

comprising—including but not limited to.

configure—to make suitable or fit for a specific use or situation.

connect—to join or fasten together.

constructed to—made suitable or fit for a specific use or situation.

controller—a device and/or system constructed to regulate flow.

convert—to transform, adapt, and/or change.
convey—to take from one place to another.
coupleable—capable of being joined, connected, and/or linked together.
coupling—linking in some fashion.
create—to bring into being.
define—to establish the outline, form, or structure of.
determine—to obtain, calculate, decide, deduce, and/or ascertain.
device—a machine, manufacture, and/or collection thereof
discharge—to send forth from an aperture.
discharge assembly—a system constructed to send forth a liquid stream.
dispense—to distribute.
dispensing end—an extremity of a system that distributes a liquid or gel.
facing—to look in a direction of.
faucet—a system constructed to control a flow of liquid from a pipe.
fixed—placed so as to be firm and not readily movable.
flow—a stream of liquid or gel.
friction—surface resistance to motion.
generate—to create, produce, give rise to, and/or bring into existence.
hand—a terminal part of a complete human arm.
increase—to make greater.
install—to connect or set in position and prepare for use.
left—toward the west when the subject is facing north
liquid—a substance in a physical state in which it does not resist change of shape but does resist change of size.
may—is allowed and/or permitted to, in at least some embodiments.
method—a process, procedure, and/or collection of related activities for accomplishing something.
middle column—a portion of a faucet substantially centered within the discharge portion of the faucet.
offset—placed away from a centerline.
outer—situated on the outside of something.
plurality—the state of being plural and/or more than one.
pop up—raised from a surface.
portion—a part of.
predetermined—established in advance.
protrude—to be raised from a service.
provide—to furnish, supply, give, and/or make available.
pump activator—a device and/or system constructed to start, stop, and/or regulate a flow of a fluid.
receive—to get as a signal, take, acquire, and/or obtain.
region—part of a surface or body.
request—to express a desire for and/or ask for.
reservoir—a place where a liquid or gel is stored.
responsive—reacting to a stimulus.
rotational direction—an angular line along which something moves (i.e., clockwise or counterclockwise).
select—to make a choice or selection from alternatives.
set—a related plurality.
soap—a substance used for washing and cleansing purposes.
start and stop—initiate and cease.
substantially—to a great extent or degree.
support—to bear the weight of, especially from below.
surround—to substantially encircle.
system—a collection of mechanisms, devices, machines, articles of manufacture, processes, data, and/or instructions, the collection designed to perform one or more specific functions.
tube—an at least partially hollow cylindrical body constructed to convey or contain a liquid.
twist—to turn rotationally.
user—a person that uses something.
via—by way of and/or utilizing.
view—to observe.

Note

Still other substantially and specifically practical and useful embodiments will become readily apparent to those skilled in this art from reading the above-recited and/or herein-included detailed description and/or drawings of certain exemplary embodiments. It should be understood that numerous variations, modifications, and additional embodiments are possible, and accordingly, all such variations, modifications, and embodiments are to be regarded as being within the scope of this application.

Thus, regardless of the content of any portion (e.g., title, field, background, summary, description, abstract, drawing figure, etc.) of this application, unless clearly specified to the contrary, such as via explicit definition, assertion, or argument, with respect to any claim, whether of this application and/or any claim of any application claiming priority hereto, and whether originally presented or otherwise:

- there is no requirement for the inclusion of any particular described or illustrated characteristic, function, activity, or element, any particular sequence of activities, or any particular interrelationship of elements;
- no characteristic, function, activity, or element is "essential";
- any elements can be integrated, segregated, and/or duplicated;
- any activity can be repeated, any activity can be performed by multiple entities, and/or any activity can be performed in multiple jurisdictions; and
- any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any claim element is followed by a drawing element number, that drawing element number is exemplary and non-limiting on claim scope. No claim of this application is intended to invoke paragraph six of 35 USC 112 unless the precise phrase "means for" is followed by a gerund.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such material is specifically not incorporated by reference herein.

Accordingly, every portion (e.g., title, field, background, summary, description, abstract, drawing figure, etc.) of this application, other than the claims themselves, is to be regarded as illustrative in nature, and not as restrictive, and the scope of subject matter protected by any patent that issues based on this application is defined only by the claims of that patent.

What is claimed is:

1. A system comprising:

a faucet comprising a discharge assembly, said discharge assembly comprising:

a middle column, said middle column comprising:

a pump activator, said pump activator constructed to cause said middle column to dispense a liquid soap responsive to user compression; and a soap tube, said pump activator substantially surrounding a portion of said soap tube comprising a dispensing end, said soap tube constructed to:

receive said liquid soap from a soap reservoir; and convey said liquid soap to a body part of said user through said dispensing end of said soap tube;

an outer tube substantially surrounding a portion of said middle column, said outer tube constructed to discharge water from an annular region between said outer tube and said middle column, said middle column comprising a water controller constructed to start and stop water flow from said annular region responsive to said user twisting said pump activator by a predetermined amount in a predetermined rotational direction.

2. The system of claim 1, wherein:

said pump activator comprises a substantially fixed pop up protruding from said pump activator, said pop up constructed to increase friction between a hand of said user and said pump activator.

3. The system of claim 2, wherein:

said pop up is offset to the left of a centerline of said pump activator when viewed facing said dispensing end of said soap tube.

4. A method comprising:

fabricating a faucet, comprising a discharge assembly, said discharge assembly comprising:

a middle column, said middle column comprising:

a pump activator, said pump activator constructed to, responsive to user compression, cause said middle column to dispense a liquid soap; and a soap tube, said pump activator substantially surrounding a portion of said soap tube, said soap tube comprising a dispensing end, said soap tube constructed to:

receive said liquid soap from a soap reservoir; and convey said liquid soap to a body part of said user through said dispensing end of said soap tube;

an outer tube substantially surrounding a portion of said middle column, said outer tube constructed to discharge water from an annular region between said outer tube and said middle column, said middle column comprising a water controller constructed to, responsive to said user twisting said pump activator by a predetermined amount in a predetermined rotational direction, start and stop water flow from said annular region.

5. The method of claim 4, wherein:

said pump activator comprises a pop up protruding from said pump activator, said pop up constructed to improve increase friction between a hand of said user and said pump activator.

6. The method of claim 5, wherein:

said pop up is offset to the left of a centerline of said pump activator when viewed facing said dispensing end of said soap tube.

* * * * *